United States Patent [19]

Pöll

[11] Patent Number: 4,935,268

[45] Date of Patent: Jun. 19, 1990

[54] DECORATIVE ELEMENT

[75] Inventor: Martin Pöll, Fritzens, Austria

[73] Assignee: D. Swarovski & Co., Wattens, Austria

[21] Appl. No.: 326,153

[22] Filed: Mar. 20, 1989

[30] Foreign Application Priority Data

Mar. 24, 1988 [DE] Fed. Rep. of Germany ..... 3810003

[51] Int. Cl.[5] ..... A44C 17/02

[52] U.S. Cl. ..... 428/15; 63/26; 156/293; 428/67; 428/79

[58] Field of Search ..... 428/15, 28, 67, 79; 156/293; 63/26, 28

[56] References Cited

U.S. PATENT DOCUMENTS

| | | | |
|---|---|---|---|
| 1,769,000 | 7/1930 | Smith | 428/67 X |
| 1,943,658 | 1/1934 | Dyckma | 63/26 X |
| 4,052,863 | 10/1977 | Poll | 428/67 X |
| 4,139,667 | 2/1979 | Blue | 428/28 X |
| 4,323,611 | 4/1982 | Poll | 63/26 X |
| 4,353,765 | 10/1982 | Covi et al. | 428/15 X |
| 4,581,088 | 4/1986 | House | 428/15 X |
| 4,604,876 | 8/1986 | Hoffmann | 428/15 X |
| 4,718,963 | 1/1988 | Poll et al. | 428/79 X |

FOREIGN PATENT DOCUMENTS

| | | |
|---|---|---|
| 1079872 | 4/1960 | Fed. Rep. of Germany . |
| 2452250 | 5/1976 | Fed. Rep. of Germany . |

*Primary Examiner*—Henry F. Epstein

*Attorney, Agent, or Firm*—Neuman, Williams, Anderson & Olson

[57] ABSTRACT

A decorative element particularly adapted for securing to an article of wearing apparel comprises a metal base member. A depression is formed in the base member for snug reception of a faceted gem which is secured in such depression by means of an adhesive. The undersurface of the base member is coated with a suitable adhesive for securing the base member and gem to a suitable substrate.

7 Claims, 1 Drawing Sheet

DECORATIVE ELEMENT

BACKGROUND OF THE INVENTION

The present invention relates to a decorative element having a gem.

Articles of clothing as well as shoes, bags, belts and the like are often provided with gems to obtain a special decorative effect. Faceted gems made of glass only show a glow when the stones are cut in one of the customary cuts, such as the brilliant cut. However, with these cuts the base of the gem is relatively large and tapers to a point. This point causes trouble when the gem is applied to textiles and the like, in particular when the point presses through the textile. Furthermore, it is relatively troublesome to apply single gems to textiles and their durability on the textile is subject to limits.

The invention is therefore based on the problem of applying gems to textiles and the like in such a way as to ensure a firm bond between the gem and the textile as well as good wearing properties, while application is simple.

The invention is based on the finding that this problem can be solved by setting the gem in a base member that is connected to the textile or the like.

The object of the invention is a decorative element characterized in that it includes a metal base member bearing on its underside a melt adhesive layer and having a centrally located depression for taking up a faceted glass gem, the depression conforming with the shape of the faceted glass gem and the faceted glass gem being glued into the depression by adhesive.

The base member is preferably made of aluminum.

The shape of the base member can basically be selected at will in accordance with decorative or ornamental points of view. Preferred embodiments are round, oval and angular, triangular, elongate, star-shaped or irregular shapes. The base member may bear one or more gems.

The base members may be punched and shaped out of sheet metal. The base member may alternatively be made of precious metals, such as gold or silver. One can also use decorative metal alloys, such as bronze. A particularly suitable material is aluminum, which can be anodized in various colors. The base member can also be colored by a layer of varnish.

The underside of the base member is provided with a melt adhesive layer for connection to the textile and the like. Suitable melt adhesives are in particular polyesters and polyamides.

The underside of the base member can be substantially flat to ensure a good bond between the melt adhesive layer and the substrate. However, a concave form of the base member is without disadvantage if the decorative elements are intended to be provided on textiles that press into the concave form.

Preferred gems are faceted glass gems, such as roses and cabochons. The glass gems can be colored, and they can also be metal-coated by an imitating layer.

The gem is seated in a depression in the base member. This depression is located in the center of the base member.

The gem can be glued into the depression using any suitable adhesive. The adhesive used is preferably thermally resistant, to avoid the danger of the gem being detached when the decorative element is being applied to a substrate.

The overall form of the inventive decorative elements is preferably of a geometric shape such that they can be screened in orifice plates to allow a plurality of single decorative elements to be transferred to a substrate, such as a textile, in an ornamental arrangement. For this purpose, in particular a plurality of individual decorative elements can be disposed in an ornamental arrangement on an aperture adhesive that serves as a transfer film, and thus be applied as an ornament. The elements are applied to the substrate in the known manner by supplying heat from above or in particular from below, for example using an iron or fix-pressing. The melt adhesive penetrates the fabric, ensuring a firm bond between the decorative element and the carrier material.

The gems used can be any gems usually used for costume jewelry, or else semiprecious stones such as opal, turquoise, jade or onyx.

The decorative elements can basically be of any size, depending primarily on the desired decorative effect and on the size of the selected gem. The decorative element preferably has a diameter of between 4 and 8 mm.

The shape of the depression intended for taking up the gem depends of course on the shape and size of the gem itself.

DESCRIPTION OF THE DRAWINGS

The invention shall be describes in more detail below with reference to the drawing, which shows an exemplary embodiment and in which.

Figure 1:
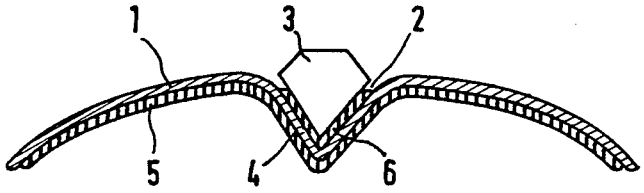
FIG. 1 shows a decorative element in cross-section.

Decorative element 1 shown is made of sheet metal and bears on its underside a melt adhesive layer 5. It is applied with this melt adhesive layer to a textile or other suitable carrier material.

Base member 1 of the decorative element has a central depression 4. A gem 3 is glued into this depression by means of adhesive layer 6.

Figure 2:
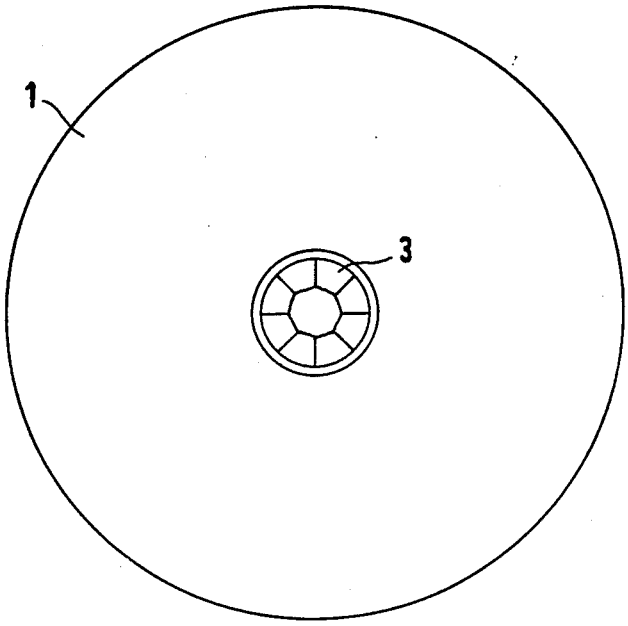
FIG. 2 shows the decorative element of FIG. 1 from the top.

Gem 3 is faceted, as apparent from FIG. 2.

I claim:

1. A decorative element comprising a metal base having a centrally located depression, a faceted gem, mounted in said base depression; said depression conforming with the shape of the portion of the faceted gem received in said depression; first adhesive means for securing said faceted gem in said depression; second adhesive means disposed on the underside of said metal base whereby said underside may be secured relative to a substrate engaging said second adhesive means on said underside.

2. A decorative element comprising a metal base having a centrally located depression, a faceted gem tapering to a pointlike terminus mounted in said base depression; said depression conforming with the shape of the portion of the faceted gem received in said depression; first adhesive means for securing said faceted gem in said depression and a melt adhesive layer disposed on the underside of said metal base whereby said underside may be secured in surface-to-surface engagement with a substrate.

3. The decorative element according to claims 1 or 2 in which the base is made of aluminum.

4. The decorative element according to claims 1 or 2 in which the base is circular when viewed from the top.

5. The decorative element according to claims 1 or 2 in combination with a substrate comprising an article of wearing apparel to which said element is secured.

6. The decorative element of claim 1 in which said second adhesive means is a melt adhesive.

7. The decorative element according to claims 1 or 2 in which the gem is made of glass.

* * * * *